US006974124B1

(12) United States Patent
Alvarez Oronoz

(10) Patent No.: US 6,974,124 B1
(45) Date of Patent: Dec. 13, 2005

(54) AUTOMOBILE LIFTING JACK

(75) Inventor: Rafael Alvarez Oronoz, Amorbieta (ES)

(73) Assignee: Batz S. Coop, Igorre (ES)

( * ) Notice: Subject to any disclaimer, the term of this patent is extended or adjusted under 35 U.S.C. 154(b) by 0 days.

(21) Appl. No.: 09/743,854

(22) PCT Filed: Apr. 26, 2000

(86) PCT No.: PCT/ES00/00152

§ 371 (c)(1),
(2), (4) Date: Apr. 18, 2001

(87) PCT Pub. No.: WO00/69772

PCT Pub. Date: Nov. 23, 2000

(30) Foreign Application Priority Data

May 17, 1999 (ES) ..... 9901043

(51) Int. Cl.[7] ..... B66F 3/00
(52) U.S. Cl. ..... 254/126; 254/122; 254/DIG. 1
(58) Field of Search ..... 254/126, DIG. 1, 254/124, 122, 7 R, 7 C, 8 B

(56) References Cited

U.S. PATENT DOCUMENTS 4,093,182 A * 6/1978 Rutenbeck ..... 254/126
4,720,081 A 1/1988 Exner
5,275,378 A * 1/1994 Alten ..... 254/126
5,782,456 A * 7/1998 Brosius et al. ..... 254/126
5,988,594 A * 11/1999 Gill ..... 254/126
6,189,865 B1 * 2/2001 Ruffie et al. ..... 254/126

FOREIGN PATENT DOCUMENTS

| | | |
|---|---|---|
| DE | 26 21 425 | 11/1977 |
| DE | 42 00 391 | 7/1993 |
| EP | 0 097 588 | 6/1983 |
| EP | 0 097 558 | 1/1984 |
| EP | 0 396 233 | 3/1990 |
| EP | 0 396 233 | 11/1990 |
| EP | 0 688 736 B1 | 6/1995 |
| EP | 0 688 736 | 12/1995 |

* cited by examiner

*Primary Examiner*—Lee D. Wilson
(74) *Attorney, Agent, or Firm*—Browdy and Neimark, PLLC

(57) ABSTRACT

A vehicle jack of the type known as "Y" jacks having a vehicle support arm (2) and a support leg (1) on which the vehicle support arm pivots. The free end of the vehicle support arm (2) includes a vehicle support plate that receives an edge of the bodywork of the vehicle, and the support leg has a swivel mounted support foot that rotates on an axis essentially parallel to the movement axis of the vehicle support arm. A bar (23) is fixed to the beginning of the vehicle support arm (2) and passes through the interior of the support leg (1) until it enters between the base of the end of the support leg (1) and the bottom of the foot (3), making contact with the foot.

9 Claims, 4 Drawing Sheets

AUTOMOBILE LIFTING JACK

DESCRIPTION

This invention relates to a jack for raising vehicles, of the type commonly known as "Y" jacks, consisting of a support leg, that at its lower end is finished in a foot that rests on the ground and a vehicle support arm to bear the weight, finishing in a vehicle support plate that receives the underside of the bodywork of the vehicle to be raised. This vehicle support arm swivels or pivots on the support leg, and the arm and leg are connected by means of a screw threaded spindle operated by a winding handle, so that the vehicle support plate is raised or lowered with the vehicle support arm by the spindle being turned in one direction or the other.

PRIOR ART

In vehicle jacks of this type, there are often problems as regards the initial positioning of the jack under the vehicle, as this positioning is not always carried out suitably by users.

Another problem that frequently arises is caused buy the fact that on starting to raise the vehicle, misalignment takes place in the load line, which might not be vertical above the support foot, which might lead to movement or even slipping of the jack.

This second disadvantage which takes place in jacks is usually the one that causes most problems during the use of these units.

In order to correct these disadvantages, several solutions have been proposed, for instance the one shown by DE.A.2625085, in which a bar runs through the interior of the support leg operated by the rotating end of the vehicle support arm by means of a notch on the edge of the latter, so that the end of the bar acts secured to a shaft that moves in a cut-out hole in a foot that finishes off the end or foot of the support leg, thus making it turn.

In another variant of this same reference, the operation of the bar is carried out by means of the turning of the nut through which the screw spindle passes at the upper end of the support leg, so that the end of the bar protrudes through the foot of the said leg and is supported on the ground through an opening in this foot.

The disadvantages of this jack with auxiliary support lies basically in the lack of reliability of the engagement of the bar in both of its versions, either though the end of the vehicle support arm or through the nut. In addition to this, it also happens that the auxiliary support has a considerable unloaded movement at the beginning of the jack raising operation.

Another jack is known though DE.AS.2621425, which is provided with an auxiliary support that uses a gear or cog wheel mechanism composed of a cam fixed to the vehicle support arm and by an edge or rim foreseen on the auxiliary support.

The reliability of this jack is low, as unwanted tolerances and considerable noise are produced, and moreover it is not free of load at the start of the jack raising operation.

Also known is the solution described by EP.A.0097558, in which a system of rods connected to a spring that is arranged on the pivoting point of the support leg and of the vehicle support arm acts on the external base of the support leg and the ground. The portion that rests on the ground protrudes to the exterior by way of a rectangular assembly.

Although this jack maintains auxiliary support with the ground in a permanent manner, it has the disadvantages of nor being very sturdy and of counting on an auxiliary support which is external in relation to the jack and which rests on the ground a certain distance from the foot on the support leg.

Also known, through EP.A.0396233, is a jack provided with an auxiliary support consisting of an auxiliary arm that turns on a parallel axis close to the pivoting point of the support leg and the vehicle support arm. The support has one bent or elbow-shaped end and its other end is equipped with two lugs. One of these lugs has teeth that engage with other teeth in one of the edges of the vehicle support arm.

Therefore, when the vehicle support arm turns, operated by the screw spindle, engagement takes place between the vehicle support arm and the auxiliary support, causing the latter to become supported on the ground.

This jack has the disadvantage that the auxiliary support is outside the body of the jack and is away from the position of the foot on the support leg. Moreover, there is the risk that during the course of the tilting of the vehicle support arm towards its highest position, disengagement might take place between the auxiliary support and the vehicle support arm.

Also known, through EP.A.0688736 is a jack provided with an auxiliary support that also uses a gearing engagement between the vehicle support arm and an internal part that runs through the support leg, which for this purpose is provided with gear teeth at its upper end. The auxiliary support runs thorough the internal base of the support leg supported by this base, with the elbow-shaped end of the auxiliary support being perpendicular to the ground.

Although this jack improves the technical characteristics of the auxiliary support, it raises the problems that considerable friction is created between the auxiliary support and the support leg, it is rather heavy and it requires the toothed areas to be made both on the vehicle support arm and on the auxiliary support, which increases the cost of the jack.

OBJECT AND SUMMARY OF THE INVENTION

One object of the invention is to provide a vehicle jack provided with an auxiliary support that has an extremely simple mechanism and is free of technical complexities, while ensuring its safe operation at all times.

Another object of the invention is a vehicle jack that provides an auxiliary support which is effective both at the start of the jack raising operation, when unloaded, and when the jack receives the load of the vehicle, while maintaining verticality between the foot of the support leg and the vehicle support plate on the vehicle support arm.

Another object of the invention is to provide a vehicle jack with an auxiliary support which is simple to manufacture, has a low cost and is totally protected inside the jack assembly.

In order to achieve these objectives the vehicle jack in the invention claims the provision of a bar, by way of a rod, which connects and clamps onto the end of the vehicle support arm received in the support leg, more specifically in the base of the said vehicle support arm, which has a U-shaped cross section, common to all jacks of this type.

The bar in question runs freely throughout the interior of the support leg until close to its lower end area, where the base of the support leg undergoes a change of direction in a quasi triangular position, on which a support foot is situated that turns on a shaft, parallel to the pivoting point of the vehicle support arm and the support leg, with this shaft being fitted between the wings or sides of the U-shaped section of the already mentioned support leg.

Precisely in the proximity of this change of angle in the base of the support leg, a protruding tongue with a hole in it is made in this base, using the material of the base itself, through which the bar in question passes towards the end base portion, which acts as a guide for the bar itself.

Starting from the position of the said tongue, the end base portion of the support leg undergoes an elevation with a central gap, from which a leg, also with a hole in it, protrudes downwards.

The bar is straight until its end at the side of the end base portion on the support leg, where it has a bend and then continues in another shorter section which is also straight in general but provided with an upward elevation by way of a wave in the proximity of its free end, with the end of this elbow-shaped elevation being finished off by a small upwardly raised section, in a relative position in which, when this smaller section is horizontal, the said end is in an upward direction.

The wave-like elevation on the shorter section of the bar moves in the gap in the elevation on the base of the support leg and goes through the downwardly protruding leg with the hole in it.

When the jack is in the folded position, the longer section of the bar passes through the holed tongue in the end of the base of the support leg and passes through the gap made in this base in order to produce the said tongue. It is precisely in this position that the bar undergoes the previously mentioned bend, running below the elevation in it and essentially parallel to this elevation.

The foot of the jack that finishes off the support leg is of a conventional U-shaped cross section and its sides or wings are connected to the sides of the said leg by a transversal shaft with a characteristic base.

The lower side of the base of this foot is equipped with the classic teeth to facilitate its grip on the ground and it has a cavity in which the end of the leg that comes from the base of the support leg is housed, in addition to its own leg, which is slightly raised, and other conventional reinforcements.

With the jack in its folded position and the foot assembled on the support leg, between the elevation in the base at the end of the leg and the bottom of the foot, a substantial horizontal gap is formed when it is supported on the ground, and the shorter section of the support bar moves in this gap at the beginning of the jack raising operation.

When the raising of the jack begins, due to the winding handle being turned, the turning of the screw spindle in the nut causes the raising of the support leg and the pivoting of the vehicle support arm that supports the load (underside of the vehicle) on the vehicle support plate.

The upward pivoting of the vehicle support arm, with the longer end of the bar fixed to its base, acts against the bar by displacing it towards the end of the base of the support leg, so that the elbow-shaped end of the shorter section of this bar acts on the upward leg on the bottom of the foot of the jack by pressing against it. As a result of this pressure, the foot tends to be turned on its axis, which causes the controlled tilting of the said foot and its being supported on the ground.

In this way, the said supporting of the foot on the ground is achieved and, in addition, it prevents the load from being incorrectly supported on raising the vehicle, so that the jack and consequently the vehicle do not slip because the vertical line of the load does not pass through the support foot.

Obviously, the contact between the elbow-shaped end of the bar and the upward protruding leg from the bottom of the foot is carried out from the position vertical to the pivoting point of the said foot and towards the support leg, so that the contact of the foot with the ground is effective and the verticality of the load in relation to the foot is maintained at all times.

The bar that gives rise to the putting into practice of this invention moves at all times in a horizontal position between the forward base of the support leg and the bottom of the foot, remaining perfectly protected from any negative external influence.

BRIEF DESCRIPTION OF THE DRAWINGS

All the details of this invention are shown in greater detail on the accompanying sheets of drawings, in which a preferred solution is illustrated, without any kind of restricting nature.

Figure 1:
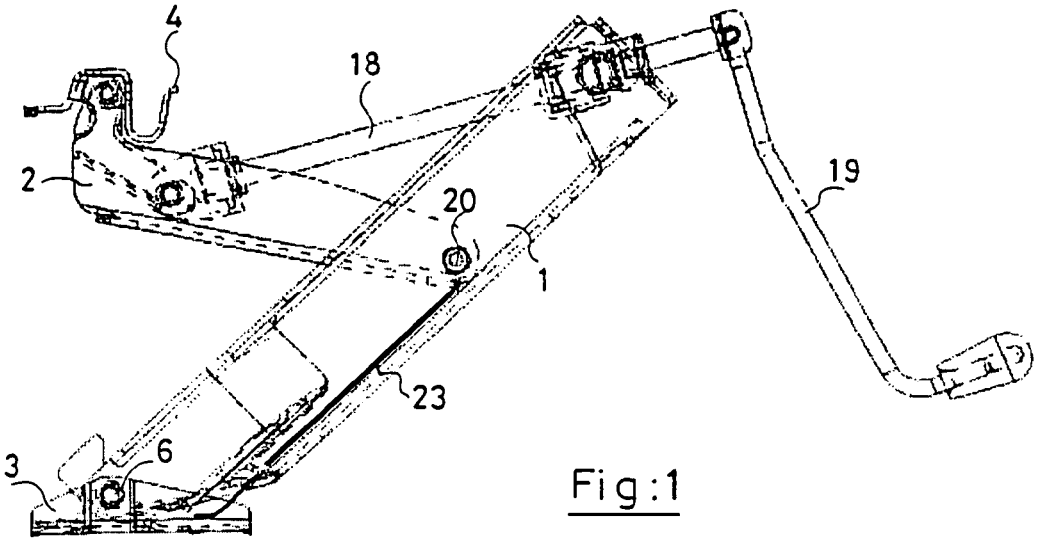
FIG. 1 represents a Y jack of the type described, in which the invention is applicable.

Looking now at FIG. 1, we can appreciate a jack in which the support leg (1) and the vehicle support arm (2) are shown, connected by means of the threaded screw spindle (18) which is turned by the winding handle (19). The vehicle support arm (2) includes the vehicle support plate that receives the bodywork of the vehicle and pivots on the axis or shaft (20) in the support leg (1).

The support leg (1) has a foot (3) that turns on an axis (6) which is parallel to the other axis (20), while the position of the bar (23) that forms the auxiliary support can be observed in diagrammatic form.

Figure 2:
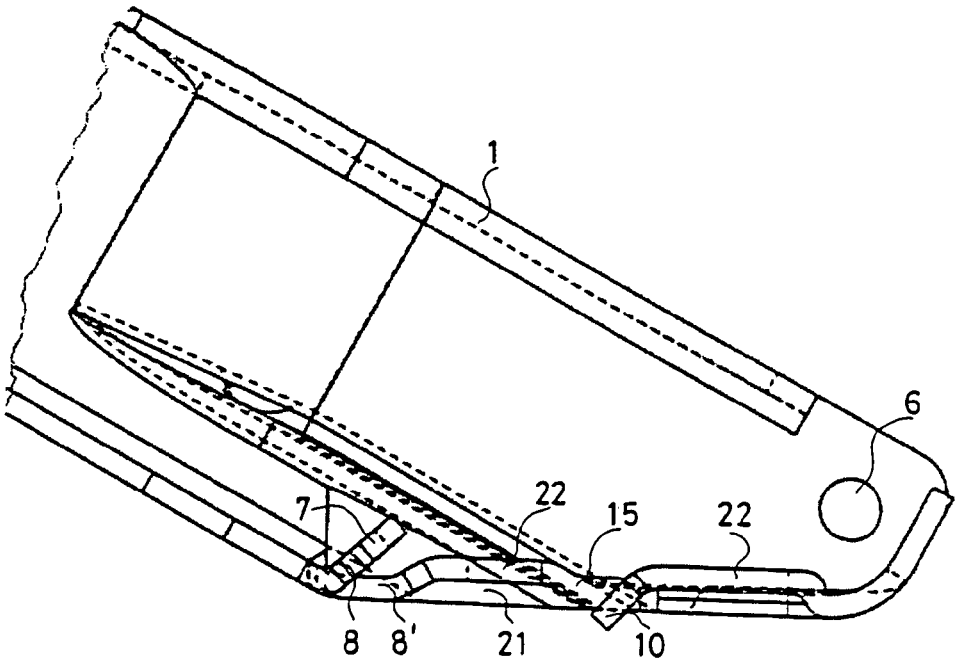
FIG. 2 represents the symmetrical half of the forward or front portion of the support leg.
Figure 6:
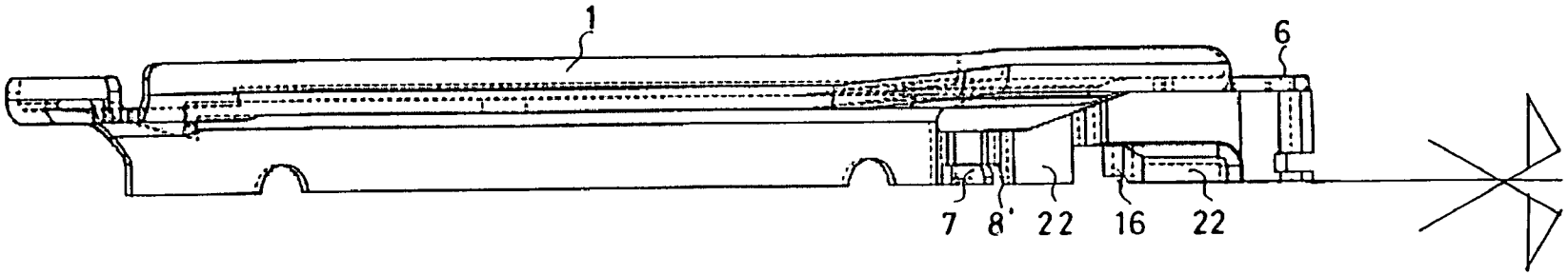
FIG. 6 is a half of a plan view of the support leg.

In accordance with FIGS. 2 and 6 the end of the support leg (1) can be appreciated on the side near the foot (3), with its base and two holes (6) for placing the pivoting shaft of the said foot. The end has a quasi-triangular shape, as can be seen, and at the start of its base the tongue (7) is formed, with its hole (8), made out of the material of the base itself, forming the lower gap or cavity (8').

The elevation (22) that provides the lower cavity (21) in its central position can be seen, on which the downward protruding leg (10) is made and in turn has a hole that provides a gap (15).

As will be proven later, the bar that forms the auxiliary support passed through the hole (8) in the tongue (7) goes through the cavity (8') and passes through the lower cavity (21) and through the holes in the downward protruding leg (10).

Figure 7:
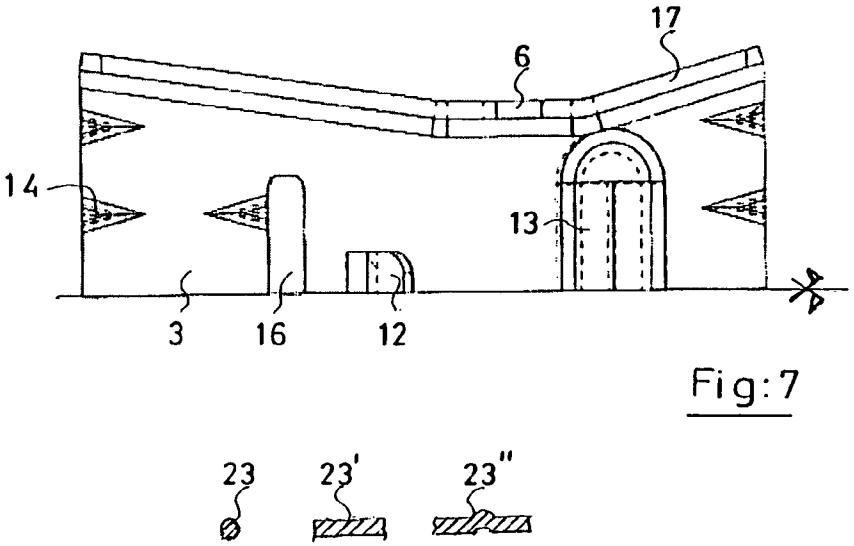
FIG. 7 is a half of a plan view of the foot of the jack.
Figure 8:
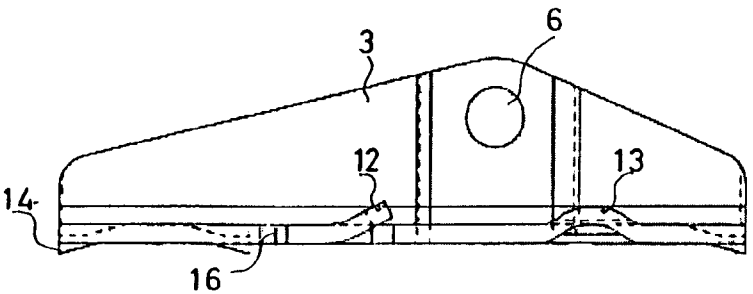
FIG. 8 is an elevation or top view of FIG. 7.

According to FIGS. 7 and 8, the foot (3) is configured based on a body with a U-shaped cross section, with the gaps (6) in its opposing wings or sides (17) facing each other in order to allow the passage of the shaft that secures it to the end of the support leg (1). The base is outwardly occupied by several protrusions or projections (14) by way of teeth that grip the ground, while we must also point out the upward leg (12) made out of the material of the base itself and the reinforcing elevation (13). The leg (12) is located to the left of the vertical of the holes (6) towards the support leg, and is used for contact, at the appropriate moment, of the end of the support bar, while the gap (16) will receive the downward leg (10) on the support leg (1).

Figure 9:
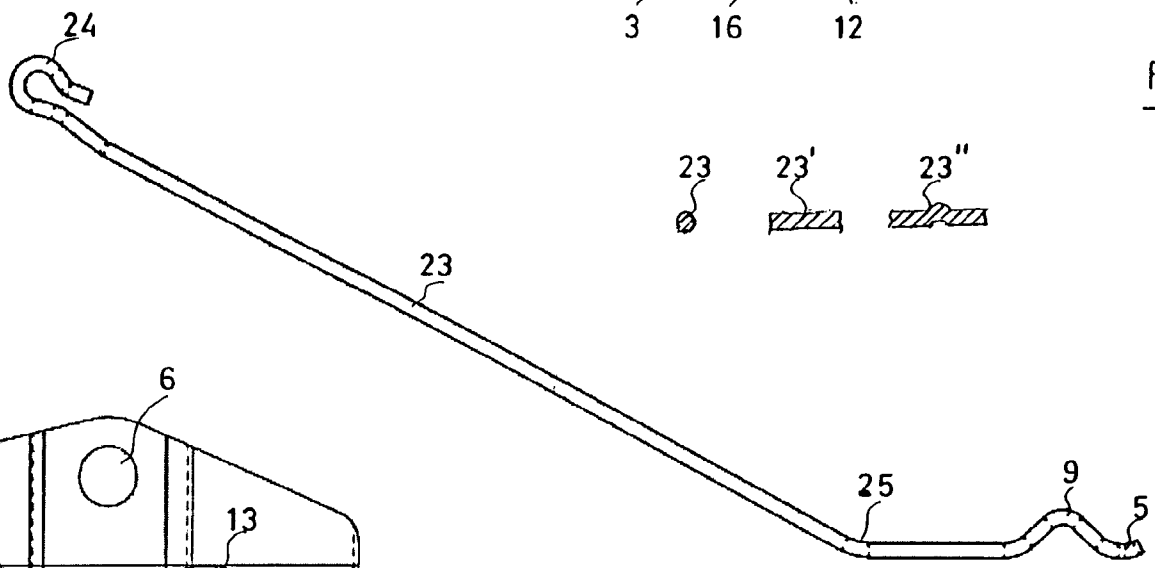
FIG. 9 is a general view of the bar which is the object of the invention, with the variants concerning the shape of its cross section.

The auxiliary bar or support (23) is shown in FIG. 9, with its two sections, the longer one straight and with its end (24) for fixing to a hole in the base of the vehicle support arm (2) in the area where it turns on the support leg (1), with both sections being separated by the elbow (25). The shorter section is initially straight and forms an obtuse angle with the longer section, while its end has an upward wave-like elevation (9) and is finished off in an upward elbow or bend (5).

The bar in question that makes up the auxiliary support can have a cross section of any kind and, as illustrated in this FIG. 9, can be circular (23), rectangular (23') or reinforced (23"), for example and, in the same way, will be made of any kind of material, such as metal, plastic, etc.

Figure 3:
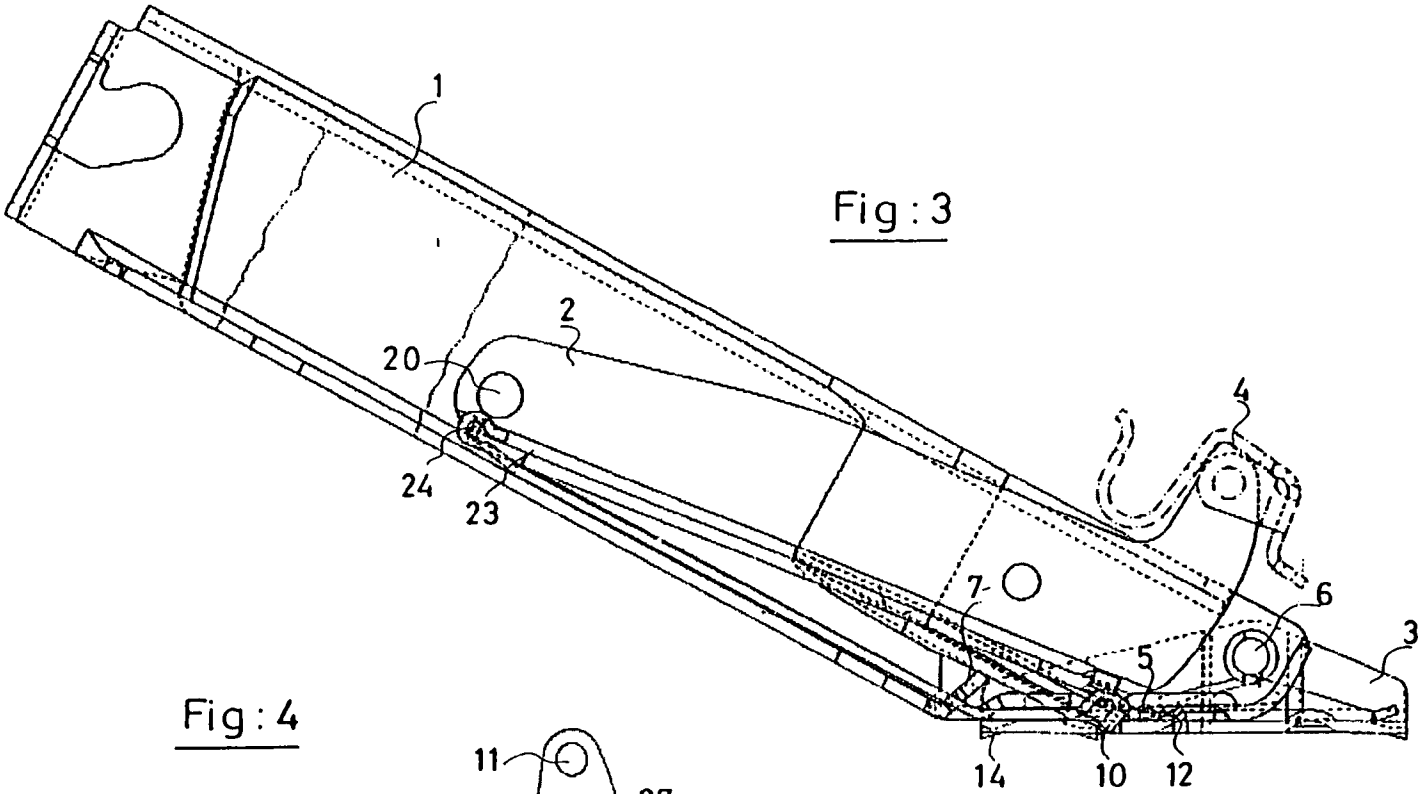
FIG. 3 shows the interrelation between the support leg, the vehicle support arm, the auxiliary support bar and the support foot, with the jack in the folded position.
Figure 5:
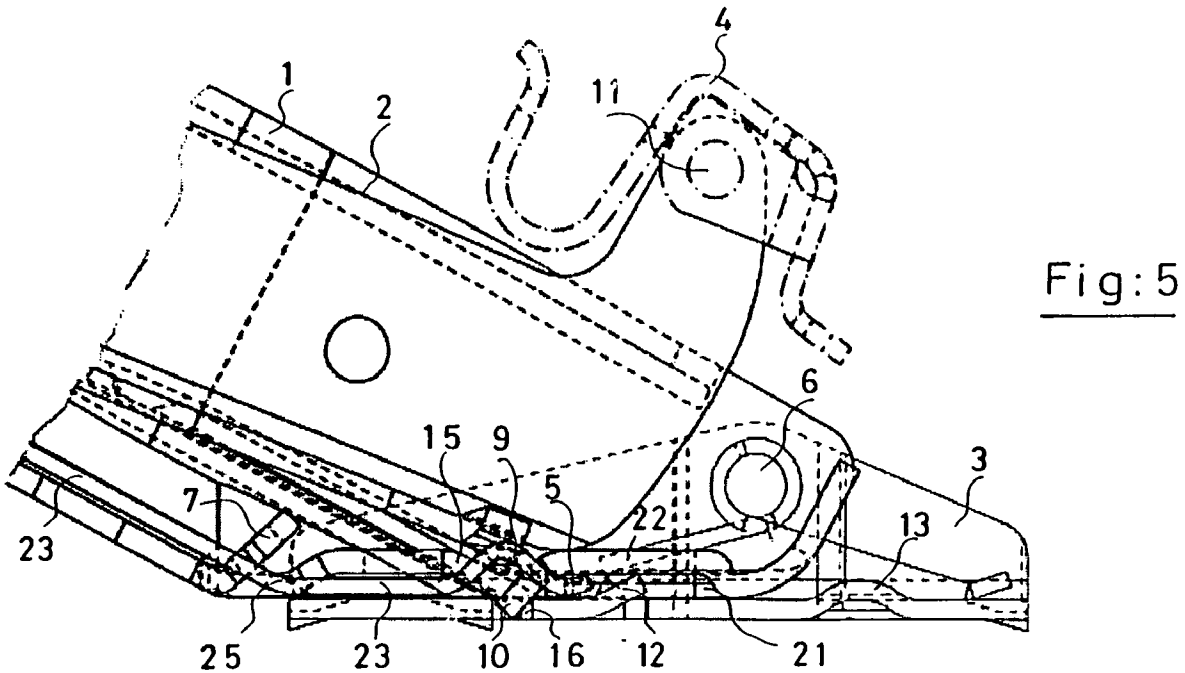
FIG. 5 is an enlarged detail of the right front part of the part shown in FIG. 3.

In accordance with FIGS. 3 and 5, we can appreciate the relative positions of the support leg (1) and the vehicle support arm (2) when the jack is folded. The bar (23) is secured by means of its end (24) to the base of the vehicle support arm (2), and more specifically to its end at the side of its pivoting point (20) on the support leg (1), and runs through the base of the support leg (1) with a longer section, until it passes through the hole (8) in the tongue (7) in the base of the end of the support leg (1), and with the shorter section of the bar running in the space provided between the elevation (22) in the base of the support leg (1) and the bottom of the foot (3).

Precisely in this position with the jack folded, the area of the elbow (25) in the bar (23) is situated in the gap (8) provided by the tongue (7) equipped with the hole (8), once it has passed through the latter, with the shorter section going between the elevation (22) in the base of the support leg (1) and the bottom of the foot, as shown.

In passing though this internal space (21), the upward elbow-shaped elevation (9) of the bar (23) becomes housed with the corresponding play in the gap (15) in the elevation (22) in the support leg (1) and its outlet passes through the holed leg (10), which in turn is received in the opening (16) in the bottom of the foot (3). The free upward elbow (5) of the bar (23) remains close to the upward leg (12) of the bottom of the foot.

The bar (23) therefore remains totally enclosed in the interior of the jack and suitably protected.

When the raising movement of the jack is initiated, the support leg (1) turns on the foot (3) and the vehicle support arm (2) also turns, raising its end on which the vehicle support plate (4) is fixed, in such a way that this turning action causes the movement and the pushing of the bar (23) towards the foot, with which the elbow-shaped end (5) makes contact and acts against the upwards leg (12) on the foot (3), causing the latter to maintain its position stable on the ground at all times.

Figure 4:
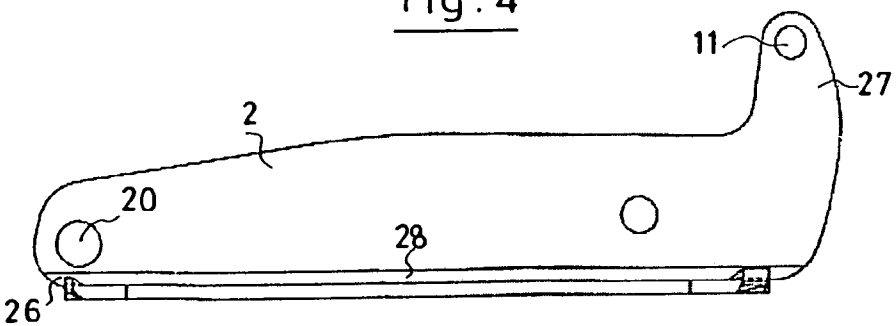
FIG. 4 is a representation of the vehicle support arm.

FIG. 4 shows the vehicle support arm (2) with two holes (20) in order to fit the pivoting shaft into the support leg (1) and the position (26) in its base in which the end (24) of the bar (23) is fixed, for example to a hole cut in the said base (28). The opposite end (27) of the vehicle support arm (2) is shown with holes (11) for the arrangement of the vehicle support plate (4).

What is claimed is:

1. A vehicle jack having a support leg (1), a foot (3) rotatably engaged on a pivot (6) on an end of the support leg (1) and a first end of a vehicle support arm (2) rotatably engaged on the support leg (1) above the foot (3) so that a threaded screw spindle (10) engaged to both the support leg (1) and the vehicle support arm (2) can be rotated by a handle (19) to turn the vehicle support arm (2) relative to the support leg (1) and raise a vehicle support (4) engaged on a second end of the vehicle support arm (2), wherein an auxiliary support (23) acts against the foot (3) during the raising of the vehicle support both when unloaded and when unloaded;

wherein the auxiliary support (23) has a first section engaged to the first end of the vehicle support arm (2) and a second section engaged to the foot (3), the second section having an elbow-shaped projection (5) at a free end thereof;

wherein the support leg (1) has a tongue (7) with a first hole (8) through which the first section of the auxiliary support (23) passes to permit the second section to engage the foot (3);

wherein the foot (3) has a leg (12) between the pivot (6) and the tongue (7) projecting up from a bottom of the foot (3) into a recess (21) in a lower end of the support leg (1) in which the free end of the second section of the auxiliary support (23) engages the leg (12).

2. A vehicle jack, in accordance with claim 1, wherein the support leg (1) has a central elevation (22) above the tongue (7) having a second hole (15) into which the elbow-shaped projection (5) projects and moves and a leg (10) projecting down from an edge of the second hole (15) engaged in a third hole (16) in the bottom of the foot.

3. A vehicle jack in accordance with claim 1, wherein the first section and the second section of the auxiliary support form an obtuse angle.

4. A vehicle jack in accordance with claim 1, wherein the auxiliary support runs through an interior of the support leg.

5. A vehicle jack in accordance with claim 1, wherein the lower end of the support leg is triangular.

6. A vehicle jack, in accordance with claim 1, wherein the auxiliary support (23) has a circular cross section.

7. A vehicle jack in accordance with claim 1, wherein the auxiliary support (23) has a rectangular cross section.

8. A vehicle jack, in accordance with claim 1, wherein the auxiliary support (23) is metallic.

9. A vehicle jack, in accordance with claim 1, wherein the auxiliary support (23) is made of synthetic material.

* * * * *